US005272289A

United States Patent [19]

Cocksedge et al.

[11] Patent Number: 5,272,289

[45] Date of Patent: Dec. 21, 1993

[54] SCRAPER CHAIN CONVEYOR

[75] Inventors: Richard Cocksedge, Doncaster, England; Clarence L. Bandy, Jr., Abingdon, Va.

[73] Assignee: American Longwall Mining Corporation, Abingdon, Va.

[21] Appl. No.: 935,631

[22] Filed: Aug. 24, 1992

Related U.S. Application Data

[63] Continuation of Ser. No. 639,208, Jan. 9, 1991, abandoned.

[30] Foreign Application Priority Data

Jun. 8, 1990 [GB] United Kingdom ..... 9012819
Jul. 7, 1990 [GB] United Kingdom ..... 9015024

[51] Int. Cl.[5] ..... B65G 19/28

[52] U.S. Cl. ..... 198/735.1; 198/735.2; 299/43

[58] Field of Search ..... 198/727, 735.1, 735.2, 198/860.2; 299/18, 43, 44, 45

[56] References Cited

U.S. PATENT DOCUMENTS 3,897,108 7/1975 Krohm et al. ..... 299/43 X
4,026,603 5/1977 Georg ..... 198/735.1
4,269,304 5/1981 Braun et al. ..... 198/735.1
4,323,282 4/1982 Braun et al. ..... 299/43
4,813,748 3/1989 Waddington et al. ..... 299/43
4,844,548 7/1989 Masovich et al. ..... 299/43

FOREIGN PATENT DOCUMENTS 2847516 5/1980 Fed. Rep. of Germany ..... 299/43
3011350 10/1981 Fed. Rep. of Germany ..... 299/43
3133233 4/1983 Fed. Rep. of Germany ..... 299/43
3318382 11/1984 Fed. Rep. of Germany ..... 299/43
0723313 2/1955 United Kingdom ..... 198/735.2
1528398 10/1978 United Kingdom .
1534029 11/1978 United Kingdom .
2054702 2/1981 United Kingdom .
2058882 4/1981 United Kingdom .
2176522A 12/1986 United Kingdom .

*Primary Examiner*—Robert P. Olszewski
*Assistant Examiner*—James R. Bidwell
*Attorney, Agent, or Firm*—King and Schickli

[57] ABSTRACT

A sigma-section profile to constitute one sidewall of a line pan to form a scraper chain conveyor, has the sidewall formed integrally as a casting, with an associated furnishing.

11 Claims, 5 Drawing Sheets

SCRAPER CHAIN CONVEYOR

This is a continuation of U.S. patent application Ser. No. 639,208, filed Jan. 9, 1991, entitled SCRAPER CHAIN CONVEYOR, now abandoned.

TECHNICAL FIELD

This invention relates to a scraper chain conveyor and in particular to a line pan from which the conveyor is constructed, and to a side wall configuration for the line pan.

BACKGROUND OF THE INVENTION

Line pans of unit length (1500 cm or 5 ft) are secured together, end-to-end in articulated manner to build up a conveyor to desired length e.g. 200 m, each pan comprising a pair of mutually facing, spaced-apart, elongate, sigma-section sidewalls, interconnected by a deck plate welded to both sidewalls to separate an upper, conveying run, from a lower return run, with a plurality of transversely extending flight bars attached at regular intervals to at least one endless chain and with a drive sprocket barrel assembly provided at at least one end of the conveyor and a return sprocket barrel assembly provided at the other end of the conveyor.

Scraper chain conveyors are used extensively in mineral mining operations, particularly coal mining, by being located along a mineral face and serving not only to convey away mineral mined from the face, but also as a guide track for an associated mining machine adapted to be reciprocated to and fro along the conveyor. Machine reciprocation is by a haulage system comprising at least one machine mounted drive sprocket, powered from an onboard source, and, for the so-called "chainless" haulages developed over the last 20 years, adapted to engage a rack associated with the conveyor. Various rack arrangements are in operation but all have required the securing, by bolting and/or welding, of mounting and/or trapping furnishings to one of the conventional sigma-section sidewalls of a line pan. Inevitably, during mining operations, damage or deformation of the furnishings occur, requiring replacement. With a wholly bolted construction, or part bolted construction, the bolts are frequently difficult to release as a result of deformation and/or rusting from water sprays provided for dust supression etc. With a wholly welded construction, or part welded construction, weld fatigue occurs due to stresses, vibrations, overloading etc., in practice, while frequently compromises must be made in the steel specification from an optimum specification to one with improved weldability, while furthermore the entire pan (conventionally 1500 cm length) must be withdrawn from the conveyor for surface repair (under British regulations) or underground repair at a safe area (under U.S. regulations).

Apart from the interruption to mineral production, the furnishings are usually outboard of the conveyor width, (c.f. GB 2,176,522, GB 2,196,366, GB 2,094,866, GB 2,058,882, GB 2,054,702, GB 1,534,029, GB 1,528,398), which may result in the taking of a reduced web of mineral during each traverse. Also, the machine must be captivated to the conveyor by slide shoes engaging a captivating flange whilst the machine must also carry a scraper to scrape fines from the top surface of the sidewall of each pan to prevent the captivating path being obstructed by fines.

SUMMARY OF THE INVENTION

According to a first aspect of the present invention, there is provided a profile, generally of sigma cross-section, to constitute one sidewall of a line pan to form, with similar line pans a scraper chain conveyor, in which the sidewall is formed and free of joints with an associated furnishing as a one-piece unit, such as a casting, the latter serving for both the trapping of an associated haulage rack arrangement and the captivation of slide shoes of an associated mining machine.

According to a second aspect of the present invention, there is provided a line pan to form part of a scraper chain conveyor, incorporating one side wall as defined above.

According to a third aspect of the invention, there is provided a scraper chain conveyor, built-up to desired length by securing together, end-to-end, a plurality of line pans in accordance with the second aspect.

With the arrangement in accordance with the invention, a more robust construction is possible as the one-piece unit is not adversely affected by vibration, stresses and rusting as is the case with bolts and welds. Furthermore, there is no difficulty in providing the furnishing within the standard width of a line pan, rather than having a disadvantageously widened line pan where outboard furnishings cannot be avoided. Preferably, a plurality of fines outlet apertures are provided in the upper flange of the sigma-section. By the location of fines outlet apertures in the upper flange of the sigma section, the fines are advantageously discharged directly into the conveying run of the conveyor, thereby minimizing any ploughing action.

The fines outlet apertures are preferably constructed by elongate slots. In detail, three may be provided in each integrally cast sidewall/furnishing.

In the basic design of the invention the furnishing is provided at an elevated location with respect to the sidewall. The furnishing and the sidewall are formed as a one-piece unit including a plurality of interconnecting webs common to both the sidewall, and in particular its upper flange, and the furnishing, the latter providing not only a captivation rail directed downwardly towards the upper surface of the upper flange of the sidewall to engage a slide shoe of a mining machine adapted to slidably engage the upper surface of the upper flange, which slide shoe is thereby captivated between the captivation rail and the upper flange, but also one half of an elongate trapping aperture for the associated rack arrangement, the other half being provided by a trapping rail extending along the conventionally provided spill plate at the goaf side of the conveyor. Such a design is satisfactory in the course of mining medium to thick mineral seams. While discharge slots are provided in the preferred embodiment, in accordance with the broader aspects of the invention these discharge slots may be omitted.

However, in accordance with a low-height design, which is particularly suitable for the mining of thin mineral seams, then compared with the basic design, the height of the trapping means is much reduced, the furnishing comprising a wall extending upwardly from the inner edge of the upper flange, the wall being formed integrally and free of joints with a pair of spaced-apart, outwardly directed ribs, which between them define a trapping gap constituting one half of a trapping means for an associated haulage rack arrangement, and the wall further being formed integrally with an inwardly projecting captivation rib for a slide shoe for a mining machine and at an upper edge of the wall, a planar slide surface to be slidably engaged by a slide shoe of the mining machine. With this arrangement the other half of the trapping means can readily be provided by welding an upright plate along an outer edge or lip of the upper flange, with a trapping rail extending inwardly from an inner face of the upright plate, to constitute the other half of the trapping means.

With this low height design, debris escape apertures are necessary rather than optional as with the basic design. Thus, apertures in the form of elongate slots may be formed in the upper flange during casting, and they may discharge either, generally inwardly, into what is the conveying run of the conveyor (see FIG. 4), or generally outwardly on to the mine floor. (see FIG. 5)

Use of the low-height, design is not of course confined to thin mineral seams, as it may be employed with equally advantageous effect in medium to thick seams, and hence has universal application. Furthermore, the low-height design provides not only a more compact, but a more robust construction than the basic design, in that there are no interconnecting webs between the sidewall and the furnishing. Furthermore, the second embodiment offers the possibility of increasing the width of the contact area between the rack arrangement and the conventionally provided haulage sprocket(s) of the associated mining machine and hence minimising if not eliminating the swaging effect that is noticable in transmitting the haulage forces involved, by these rolling faces.

BRIEF DESCRIPTION OF THE DRAWING

The invention will now be described in greater detail, by way of example, with reference to the accompanying drawings, in which.

DETAILED DESCRIPTION OF THE INVENTION

Figure 1:
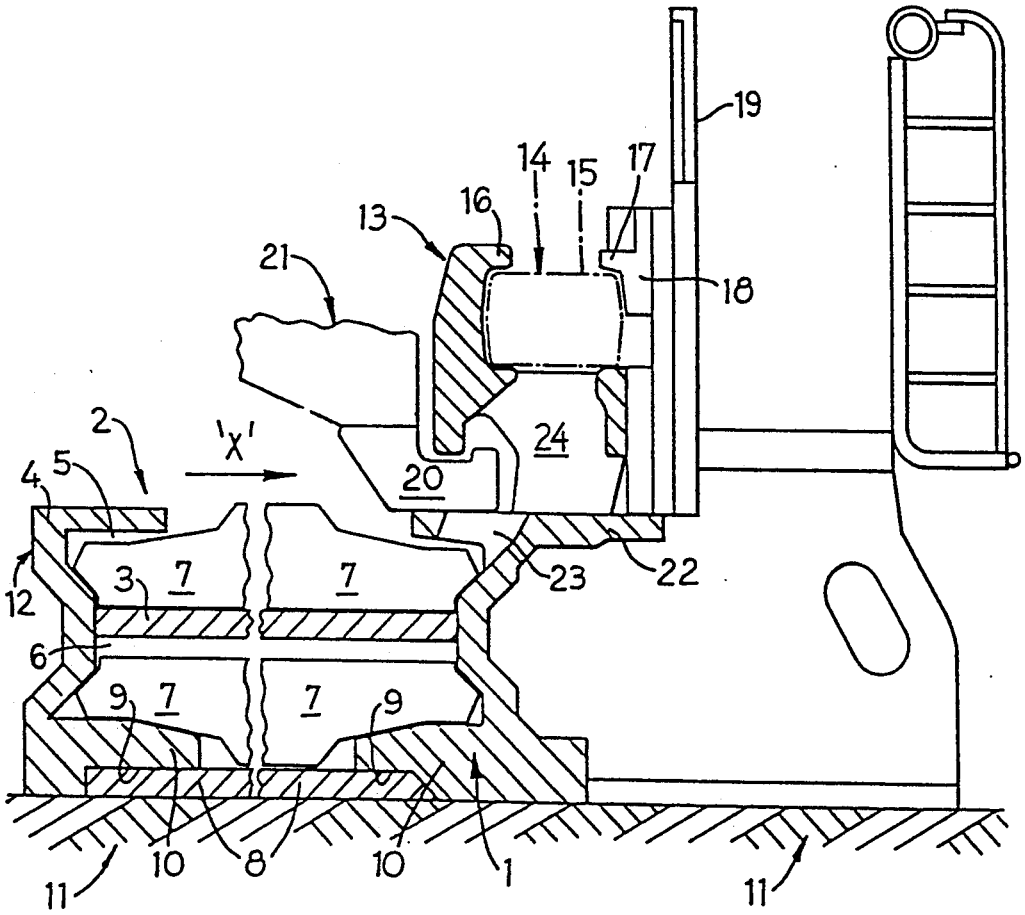
FIG. 1 is a transverse sectional view through a first embodiment of the basic design of sidewall in accordance with the first aspect of the invention.

In the drawings, a sigma-section profile constituting one, goaf-side sidewall 1, of a line pan 2, is interconnected via a deck plate 3, to another and conventional, face-side, sigma-section sidewall 4 to define an upper conveying run 5 and a lower return run 6 for flight bars 7 attached at intervals to endless chains (not shown). The line pan 2 is also conventionally provided with a floor plate 8 welded to the under surfaces 9 of lower flanges 10 of both sidewalls and seating on a mine floor 11. In the usual way, sufficient number of unit length (1500 cm) line pans 2 are assembled together, end-to-end via articulated joints, to build up a scraper chain conveyor 12 to desired length (e.g. 200 m).

In detail, the sidewall 1 is produced and free of joints, as a one-piece unit, such as a casting, with furnishing 13 which may serve, depending on the type of rack haulage system which the user wishes to install either as a rack, or a trapping arrangement for a rack 14 constituted by a plurality of interengaging blocks 15 as described in detail in pending British patent application No. 90/28022.3, published as GB 2,239,882 by the blocks 15 being trapped under lip 16 of the furnishing 13 and under lip 17 of a trapping rail 18 bolted to a conventional spill plate 19. The furnishing 13 serves secondly as a captivation means for the conventional slide shoes 20 of a longwall mining machine 21. Upper flange 22 of the goaf-side, sigma-section sidewall 1 is provided with five elongate fines discharge slots 23, at regular intervals, which slots 23 open out into the upper conveying run 5 for direct discharge of fines into that run.

Figure 2:
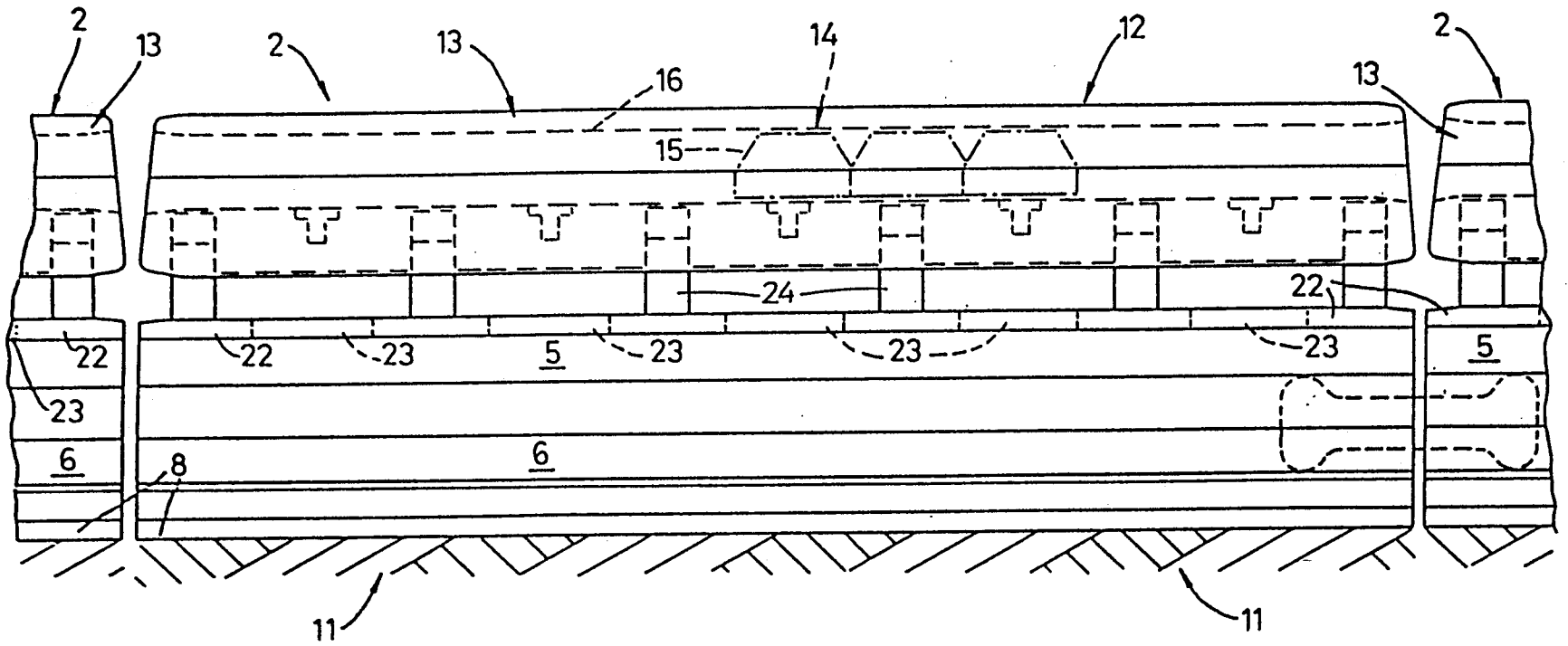
FIG. 2 is a side elevation of FIG. 1 in the direction of arrow x.
Figure 3:
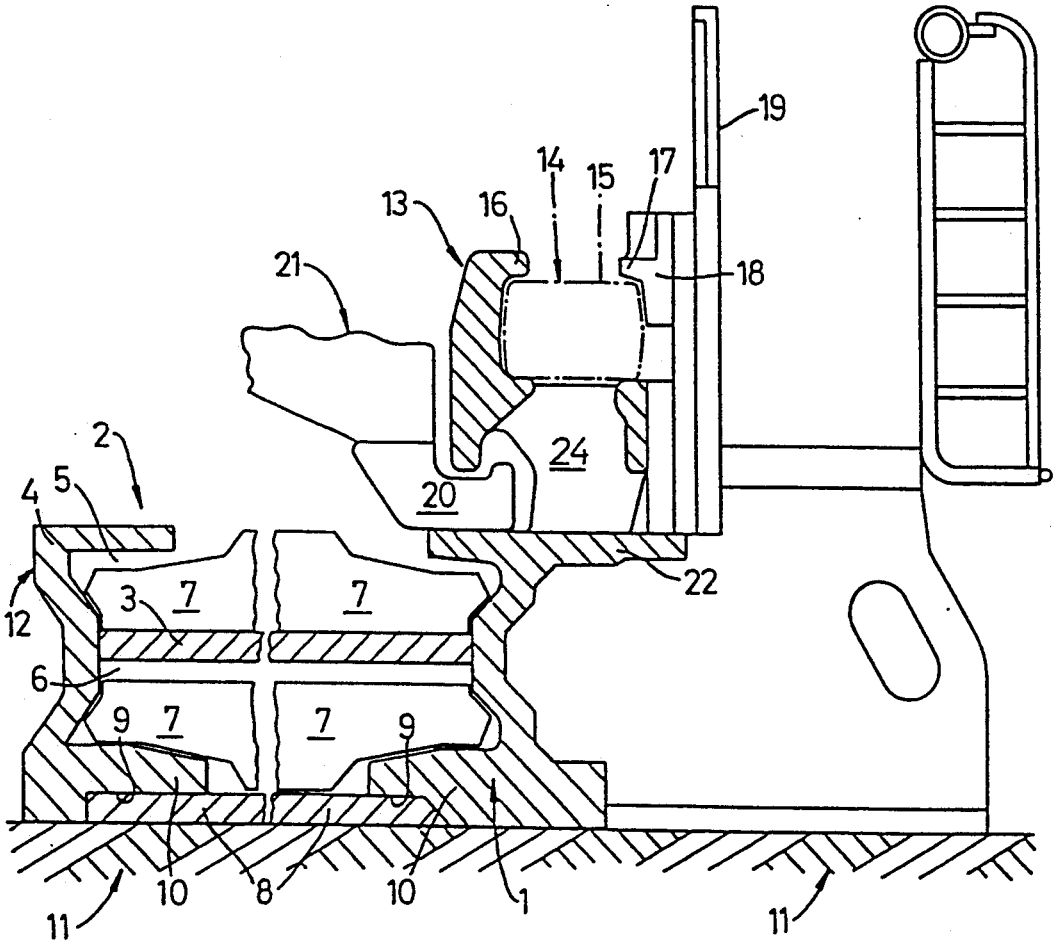
FIG. 3 corresponds to the transverse sectional view of FIG. 1, but shows a second embodiment of the basic design.

In the basic design of FIGS. 1 to 3, the furnishing 13 is attached to the sidewall 1, by a plurality of inter connecting webs 24 common to both the furnishing 13 and the sidewall 1.

Figure 4:
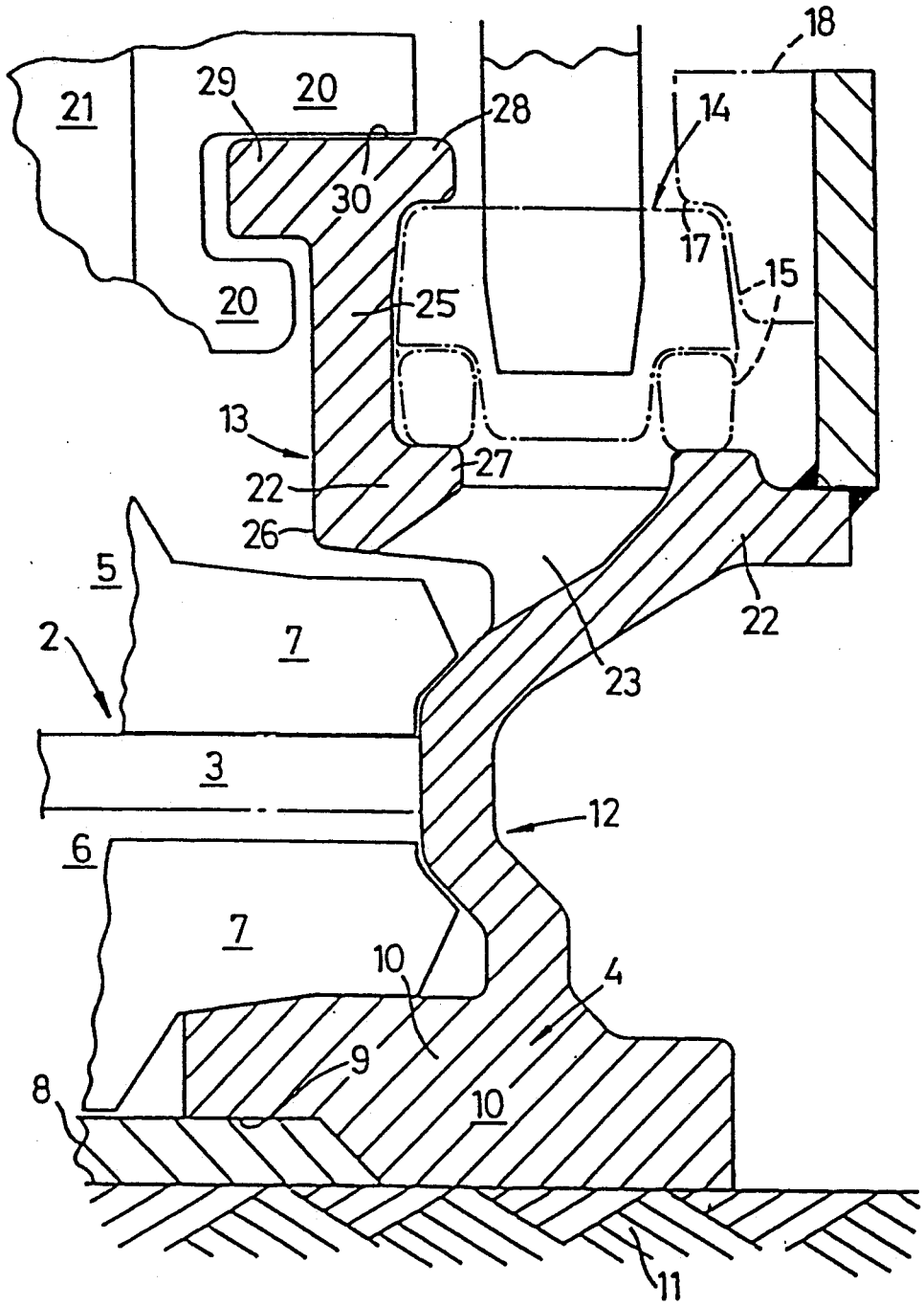
FIG. 4 corresponds to the transverse sectional view of FIG. 1 but shows a first embodiment of the low height design.
Figure 5:
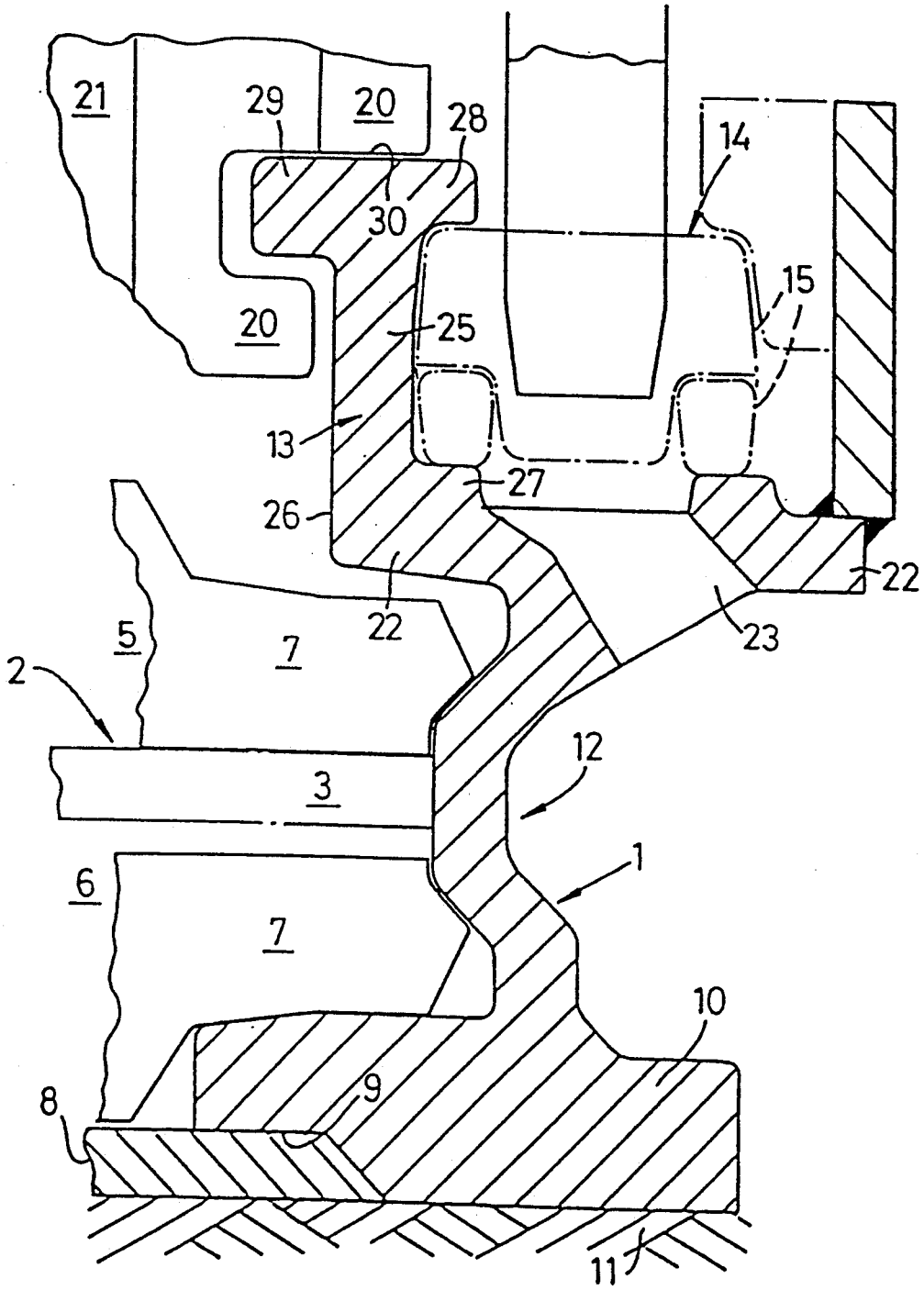
FIG. 5 corresponds to the transverse sectional view of FIG. 4, but shows a second embodiment of the low height design.

In the low height design of FIGS. 4 and 5, the furnishing 13 comprises a wall 25 extending upwardly from an inner edge 26 of the upper flange 22, the wall 25 being formed integrally with a pair of spaced-apart, outwardly directed ribs 27, 28 which between them define a trapping gap constituting one half of a trapping means for the associated haulage rack 14, and the wall 25 further being formed integrally with an inwardly projecting captivation rib 29 for the slide shoe 20 of the mining machine 21 and at an upper edge of the wall 25, a planar slide surface 30 to be slidably engaged by the slide shoe 20 of the mining machine 21. With the low-height design of FIG. 4, slots 23 discharge debris into the conveying run 5, while in the low-height design of FIG. 5, slots 23 discharge debris onto the mine floor 11 at the goaf side.

We claim:

1. A sigma-section profile to constitute one sidewall of a line pan to form a scraper chain conveyor, wherein said sidewall is formed integrally, as a casting, with an associated furnishing, said furnishing comprising a wall extending upwardly from an inner edge of an upper flange, said wall being formed integrally with a pair of spaced-apart, outwardly directed ribs which between them define a trapping gap constituting one half of a trapping means for said haulage rack arrangement, and said wall further formed integrally with an inwardly projecting captivation rib for said slide shoes and, at an upper edge of said wall, with a planar slide surface to be slidably engaged by said slide shoes with at least one aperture in said upper flange for discharge of fines from said trapping gap, said furnishing serving for both the trapping of an associated haulage rack arrangement, and for the captivation of slide shoes of an associated mining machine.

2. A profile as claimed in claim 1, wherein an upright plate is welded along an outer edge of said upper flange, and an inner face of said upright plate is provided with an inwardly extending trapping rail, to constitute the other half of said trapping means.

3. A scraper chain conveyor unit for cooperating with a mining machine having slide shoes and driven by a haulage system, including a rack; comprising a line pan, said line pan having a pair of sigma-section sidewalls interconnected by a transverse deck plate to define an upper conveying run and a lower conveying run; and a furnishing, said furnishing serving as a trapping means for said haulage rack and a captivation means for said slide shoes of said mining machine, each of said furnishings being integrally cast and free of joints with an associated one of said line pan sidewalls as a single piece body, whereby is provided a sturdy, stress resistant structure of said furnishing and said sidewall.

4. A conveyor unit as claimed in claim 3, wherein a plurality of fines outlet apertures are provided in an upper flange of said sigma-section sidewall.

5. A conveyor unit as claimed in claim 4, wherein said apertures are elongated slots.

6. A conveyor unit as claimed in claim 5, wherein at least three slots are provided for each unit.

7. A conveyor unit as claimed in claim 3, wherein said furnishing comprises a wall extending upwardly from an inner edge of an upper flange, said wall being formed integrally with a pair of spaced-apart, outwardly directed ribs which between them define a trapping gap constituting one half of a trapping means for said haulage rack arrangement, and said wall further formed integrally with an inwardly projecting captivation rib for said slide shoes of said associated mining machine and, at an upper edge of said wall, with a planar slide surface to be slidably engage by said slide shoes with at least one aperture in said upper flange for discharge of fines from said trapping gap.

8. A conveyor unit as claimed in claim 7, wherein an upright plate is welded along an outer edge of said upper flange, and an inner face of said upright plate is provided with an inwardly extending trapping rail, to constitute the other half of said trapping means.

9. A conveyor unit as claimed in claim 5, wherein said slots are so located as to discharge debris generally inwardly, into the conveying run.

10. A conveyor unit as claimed in claim 5, wherein said slots are so located as to discharge debris generally outwardly, onto the adjacent mine floor.

11. A scraper chain conveyor, built-up to desired length by securing together, end-to-end, a plurality of conveyor units as claimed in claim 3.

* * * * *